United States Patent [19]

Tengzelius et al.

[11] 4,090,868

[45] May 23, 1978

[54] PHOSPHORUS STEEL POWDER AND A METHOD OF MANUFACTURING THE SAME

[76] Inventors: Jan Robert Tengzelius, Oxelvagen 37, 260 40, Viken; Per Folke Lindskog, Langgatan 21; Lars-Erik Svensson, Mollebacken 8, both of, 263 00 Höganäs, all of Sweden

[21] Appl. No.: 735,132

[22] Filed: Oct. 26, 1976

[51] Int. Cl.[2] ..... B22F 1/00

[52] U.S. Cl. ..... 75/0.5 R; 75/0.5 AA; 75/0.5 BA; 75/251; 75/252

[58] Field of Search ..... 75/0.5 BA, 0.5 AA, 0.5 R, 75/251, 252

[56] References Cited

U.S. PATENT DOCUMENTS 3,357,817 12/1967 Harnisch et al. ..... 75/.5 BA 3,836,355 9/1974 Lindskog et al. ..... 75/.5 BA 3,839,014 10/1974 Cziska et al. ..... 75/.5 BA

*Primary Examiner*—W. Stallard

*Attorney, Agent, or Firm*—Albert L. Jeffers

[57] ABSTRACT

A phosphorus steel powder for manufacturing sintered details having an extremely small tendency to brittleness ruptures consists of iron or steel powder substantially free from phosphorus, mixed with a phosphorus powder containing in all less than 4% impurities which are at the sintering temperature more easily oxidized than the main components iron and phosphorus. The iron-ferrophosphorus mixture is heated with or without the addition of oil in reducing atmosphere to a temperature of between 65° and 900° C for a period of 15 minutes to 2 hours to improve the protection against segregation.

17 Claims, 4 Drawing Figures

PHOSPHORUS STEEL POWDER AND A METHOD OF MANUFACTURING THE SAME

BACKGROUND OF THE INVENTION

1. Field of the Invention

The present invitation relates to phosphorus steel powder mixtures to be used within the powder metallurgy. In addition to iron an phosphorus these powder mixtures can contain other alloying elements common within this technique, such as copper, nickel, molybdenum, chromium and carbon.

2. DESCRIPTION OF THE PRIOR ART

The use of phosphorus as an alloying element within the powder metallurgy has been known since the forties. Sintered steel alloyed with phosphorus has substantially improved strength characteristics in relation to non-alloyed sintered steel. Already at an early date there were for this object used mixtures of pure iron powder and ferrophosphorus powder. However, the ferrophosphorus first used has a composition which made it extremely hard and caused a considerable wearing of the tools. This drawback has been reduced to an acceptable degree by using a ferrophosphorus powder having a lower content of phosphorus and thereby reduced hardness, see for example Swedish Patent. No. 372,293.

However, sintered details manufactured by pressing and sintering such steel powder mixtures sometimes have an unacceptable brittleness. This is revealed for example by the fact that a population of sintered tests bars made from these mixtures can comprise individuals having extremely reduced mechanical characteristics especially with regard to impact strength and permanent strain after rupture (break elongation). As the advantage of phosphorus alloyed sintered steels is high strength in combination with very good strain characteristics the above brittleness risks are very serious.

Said brittleness risk has shown up to be present when the ferrophosphorus is of such composition that there is established a liquid phase at the sintering temperature. At the usually used sintering temperatures, 1040° C and above that, this fact provides that phosphorus contents of more than 2.8% in the ferrophosphorus give a sintered material having an increased brittleness risk. The fact that ferrophosphorus having a high phosphorus content is used in spite of this drawback is dependent on the favorable sintering process which is provided by the liquid phase and the favorable distribution of the phosphorus in turn providing for a rapid indiffusion thereof which is obtained because of the fact that the ferrophosphorus provides for a liquid phase.

SUMMARY OF THE INVENTION

Thus, the object of the present invention is to solve said problems with regard to the brittleness of sintered steel manufactured from a mixture of iron powder and a ferrophosphorus powder having a phosphorus content exceeding 2.8%. The solution of the problem has proved to reside in the use of a ferrophosphorus powder having a low content of impurities, especially impurities sensitive to oxidation. A further improvement can be obtained if the ferrophosphorus powder also has a small maximum particle size.

A phosphorus steel powder according to the invention for manufacturing sintered details having an extremely small tendency to brittleness ruptures consists of iron or steel powder substantially free from phosphorus, mixed with a phosphorus powder containing in all less than 4%, preferably less than 3% impurities which are at the sintering temperature more easily oxidized than the main components iron and phosphorus. Furthermore, the particles of the ferrophosphorus powder shall have a maximum size of 20 μm, preferably a maximum size of 10 μm. The phosphorus content of the ferrophosphorus powder shall exceed 2.8% and in order to reduce the wearing of the tools the phosphorus content shall be less than 17%. If the ferrophosphorus powder is manufactured by grinding piece goods the phosphorus content shall exceed 12% and shall preferably be between 14 and 16%. The phosphorus content of the preferred mixture is between 0.2 and 1.5%.

In this case there is a great difference between the particle sizes of the powder components in the mixture leading to an especially great risk of segregation and thereby of a discontinuous distribution of the alloying elements. In order to reduce the tendency of the mixture to segregate after the mixing operation 50 – 200 g of a light material oil per metric ton powder can be added during the mixing operation. Thereby the fine alloying particles are brought to adhere to the coarser iron powder particles.

In order to remove the protection against segregation the iron-ferrophosphorus mixture is heated with or without the addition of oil in reducing atmosphere to a temperature of between 650° and 900° C for a period of 15 min. to 2 hours. Thereby, the powder is loosely sintered together so that a following cautious disintegration has to be carried out in order to restore the original particle size. The powder provided in this way has iron particles with particles of the fine grained ferrophosphorus powder sintered thereto.

The methods described above in order to avoid segregation can be performed to a mixture having an increased content of the phosphorous powder. The concentrate so obtained can be mixed with the iron powder to provide for the desired phosphorus content in the final product.

DESCRIPTION OF THE PREFERRED EMBODIMENTS

Figures 1, 2, 3, 4:
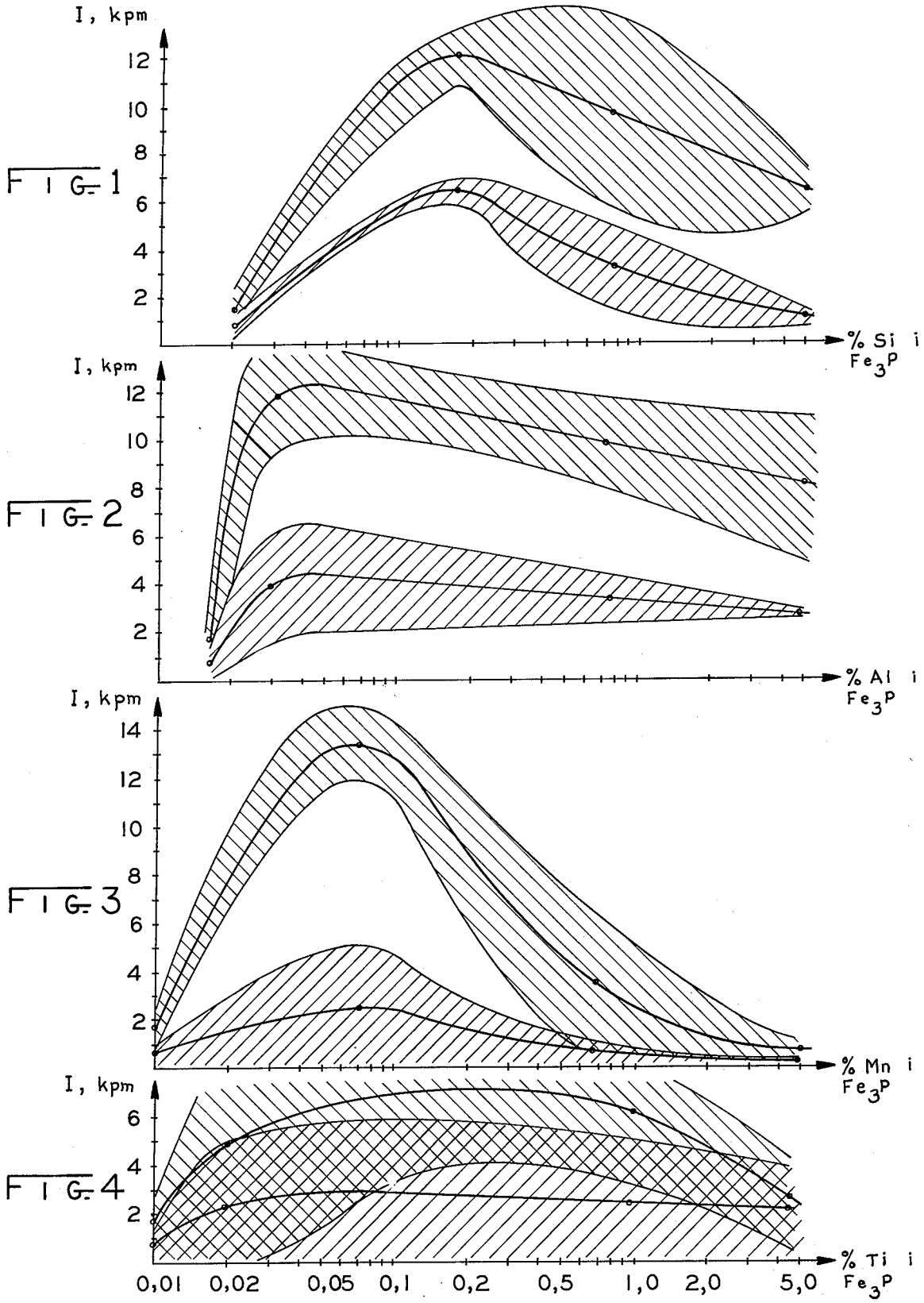
FIGS. 1 to 4 are plots of impact strength along the ordinates vs. alloy percentage compositions, for different alloy compositions of this invention with alloy component particle size shown as parameters.

The critical contents of the impurities appear from the following examples.

EXAMPLE 1

Three melts of iron-phosphorus including 15.5 – 16.5% phosphorus and controlled contents of silicon of 0.02, 0.17, 0.75 and 4.81% and additional impurity contents of ≦ 0.01% were manufactured and were allowed to solidify. Thereupon, they were ground to a powder form which two size classes were taken out, 0 – 10 μm and 10 – 40 μm. These phosphorous powders were mixed with extremely pure iron powder so that the mixture got a phosphorus content of 0.6%, whereupon the mixture was compressed to impact strength test bars without indications of fracture having a size of 55 × 10 × 10 mm. The bars were sintered in cracked ammonia at 1120° C for 1 hour. The impact strength was tested at room temperature by means of a Charpy pendulum hammer. The result is shown in FIG. 1 wherein the impact strength (I) relates to the mean value including the standard deviation for 7 bars.

The curves clearly show the advantage of the phosphorus powder having partly a small particle size and partly a low silicon content. The silicon content shall be less than 0.5%, preferably less than 0.2%, for giving the impact strength a stable high value. However, the silicon content shall not be too low but exceed 0.05%, preferably exceed 0.1%.

EXAMPLE 2

Iron-phosphorus alloying powder having aluminium as the only impurity element was manufactured in the same way as according to the preceding example. Three different contents of aluminium were used: 0.15, 0.03, 0.8 and 4.8%. Also powders having two different particles sizes, namely 0 – 10 μm and 10 – 40 μm, were manufactured. The further treatment and the return of the results are the same as according to example 1, see FIG. 2.

The same conclusion concerning the particle size can be drawn from this example as from example 1. Also according to this example the toughness is better when the impurity contents are low. A suitable maximum content of aluminium in the iron-phosphorus-alloying powder is 3%, preferably 2%, and a suitable minimum aluminium content is 0.02%.

EXAMPLE 3

The same tests as according to the above examples were conducted with iron-phosphorus-alloys, this time having manganese as the only impurity element with a content of 0.01, 0.07, 0.68 and 5.0%. The phosphorus content varied between 17.2 and 17.5%. The result appears from FIG. 3.

Once more the example shows the importance of a small particle size of the iron-phosphorus alloying powder. Furthermore, the manganese content should be less than 0.25%, preferably less than 0.15%, and higher than 0.03%, preferably higher than 0.05%.

EXAMPLE 4

The same tests as according to the above examples were conducted. The phosphorus content of the iron-phosphorus powders was 16.7 – 17.6% while the only impurity element this time was titanium in the amounts of 0.01, 0.02, 1.0 and 4.4%. The result appears from FIG. 4.

Also this example shows, even if not as striking as the previous example, that the particle size of the iron-phosphorus-powder shall be low. Also the content of titanium shall be relatively low, less than 3%, preferably less than 2%. If the content of titanium is lowered too much, the brittleness phenomena appears again, for which reason this content shall exceed 0.02%, preferably exceed 0.05%. The following example shows this fact even more clearly.

EXAMPLE 5

An iron-phosphorus-alloy was manufactured by melting extremely pure raw materials (the same as used according to the previous examples). No artificial impurity elements were added. The alloy was of the following composition: 17.4% P, 0.02% Si, <0.03% Al, 0.01% Mn, 0.01% Mg, 0.01% Ti, balance Fe. The alloy was crushed, ground and screened to a powder having a particle size partly less than 10 μm, partly between 10 – 40 μm. The iron-phosphorus powder was mixed with the same pure iron powder as according to previous examples to a phosphorus content of 0.6%. Impact strength test bars were pressed from the powder mixture, and the bars were sintered in cracked ammonia at 1120° C for a period of 1 hour. The impact strength of the sintered bars was tested according to Charpy. When the particle size of the iron-phosphorus powder was less than 10 μm the mean value of the impact strength for seven test bars was 1.6 kpm (15.7 J) and the standard deviation was 0.8 kpm (7.8 J). The corresponding values for the case of the added iron-phosphorus powder having a particle size between 10 and 40 μm were 0.6 kpm (5.9 J) and 0.4 kpm (3.9 J), respectively.

This example evidently shows that the brittleness risk in connection with phosphorus sintered steel manufactured from a mixture of iron-phosphorus powder and iron powder is great when using extremely pure iron-phosphorus material. Therefore, the total content of impurities which are more easily oxidized than iron and phosphorus at the sintering temperature should exceed 0.1%.

Thus, the present invention represents a solution of the problem of brittleness ruptures sometimes appearing in sintered steel manufactured from a mixture of iron powder and ferrophosphorus powder. The solution resides in the fact that the ferrophosphorus powder shall have a content of impurities oxidizable at the sintering conditions which is as low as possible, the total content of such impurities shall however exceed 0.1%. The allowable maximum content of these impurities is 4% and these limits have been defined for allowing contents of certain, especially sensitive impurities.

We claim:

1. A phosphorus steel powder for manufacturing sintered mouldings having high toughness, consisting of a steel powder substantially free from phosphorus and having a good compressability, which is intimately mixtured with ferrophosphorus powder having a phosphorus content exceeding 2.8 weight-%, in such an amount that the phosphorus content of the mixture is 0.2 to 1.5%, wherein the total content of impurities which are at the sintering temperature more easily oxidized than the main components iron and phosphorus does not exceed 4%, and the ferrophosphorus powder has a maximum particle size of 20 μm.

2. A phosphorus steel powder as claimed in claim 1, wherein the content of impurities which are at the sintering temperature more easily oxidized than iron and phosphorus is at least 0.1%.

3. A phosphorus steel powder as claimed in claim 1, wherein the silicon content is less than 0.5%, and exceeds 0.05%.

4. A phosphorus steel powder as claimed in claim 1 wherein the aluminium content is less than 3%, and exceeds 0.02%.

5. A phosphorus steel powder as claimed in claim 1, wherein the manganese content is less than 0.25%, and exceeds 0.03%.

6. A phosphorus steel powder as claimed in claim 1, wherein the titanium content is less than 3%, and exceeds 0.02%.

7. A phosphorus steel powder as claimed in claim 1, further comprising 0.005 – 0.02% of a fluent mineral oil for obviating segregation.

8. A phosphorus steel powder as claimed in claim 1, wherein the ferrophosphorus particles are by means of sintering substantially adhered to the steel powder particles for obviating segregation.

9. The powder of claim 1 wherein said phosphorus content is between 12 and 17 by weight-%.

10. The powder of claim 1 wherein the maximum particle size is 10 μm.

11. A phosphorus steel powder for manufacturing sintered mouldings having high toughness, consisting of a steel powder substantially free from phosphorus and having a good compressibility, which is intimately mixtured with ferrophosphorus powder wherein the total content of impurities which are at the sintering temperature more easily oxidized than the main components iron and phosphorus does not exceed 4%, and the ferrophosphorus powder has a maximum particle size of 20 μm.

12. The powder of claim 11 wherein said ferrophosphorus powder has a maximum particle size of 10 μm.

13. A method of manufacturing a phosphorus steel powder comprising the steps of intimately mixing a basic amount of steel powder with ferrophosphorus powder having a maximum particle size of 20 μm and an impurity content for each impurity less than 3.0% and greater than 0.01%, wherein the impurities are selected from one of the groups of silicon, aluminum, manganese, and titanium, and adhering the ferrophosphorus particles to the steel powder particles, and with the total of the impurities being greater than 0.1%.

14. The method of claim 13 wherein said impurity is silicon and said range is between 0.5% and 0.05%.

15. The method of claim 13 in which said impurity is aluminum and said range is between 3% and 0.02%.

16. The method of claim 13 wherein said impurity is manganese and the range is between 0.25% and 0.03%.

17. The method of claim 13 wherein the impurity is titanium and the range is between 3% and 0.02%.

* * * * *